US005335872A

United States Patent [19]

Clubbs

[11] Patent Number: 5,335,872

[45] Date of Patent: Aug. 9, 1994

[54] PROTECTIVE CORE

[75] Inventor: William R. Clubbs, Victoria, Australia

[73] Assignee: John Lysaght (Australia) Limited, Sydney, Australia

[21] Appl. No.: 910,891

[22] Filed: Jul. 10, 1992

[30] Foreign Application Priority Data

Jul. 12, 1991 [AU] Australia ..... PK7163

[51] Int. Cl.[5] ..... B65H 16/02

[52] U.S. Cl. ..... 242/610.6; 242/118.1; 138/98; 138/118

[58] Field of Search ..... 242/68.5, 68.6, 72 R, 242/118.1, 118.11, 118.2, 118.32; 138/98, 118, 119, 148, 172

[56] References Cited

U.S. PATENT DOCUMENTS

| | | | |
|---|---|---|---|
| 1,005,787 | 10/1911 | Sibley | 242/68.5 |
| 2,328,335 | 8/1943 | Fryer et al. | 242/118.2 |
| 2,659,543 | 11/1953 | Guyer | 242/72 R |
| 2,693,918 | 1/1954 | Bretson et al. | 242/68.5 |
| 3,152,692 | 10/1964 | Johnston | 242/68.5 |
| 3,396,918 | 8/1968 | Adamson et al. | 242/72 R X |
| 3,433,355 | 3/1969 | Smith | 242/72 R X |
| 3,865,325 | 2/1975 | Newcomer, Jr. | 242/68.5 |
| 4,240,593 | 12/1980 | Bell et al. | 242/68.5 X |
| 4,442,686 | 4/1984 | Beffart et al. | 242/118.1 X |
| 4,832,276 | 5/1989 | Gebhardt et al. | 242/72 R X |
| 4,923,137 | 5/1990 | Jorgensen et al. | 242/68.5 |

FOREIGN PATENT DOCUMENTS

| | | | |
|---|---|---|---|
| 3326425 | 2/1985 | Fed. Rep. of Germany | 242/68.5 |
| 1593250 | 7/1981 | United Kingdom | 242/68.5 |

*Primary Examiner*—Daniel P. Stodola
*Assistant Examiner*—John P. Darling
*Attorney, Agent, or Firm*—Nikaido, Marmelstein, Murray & Oram

[57] ABSTRACT

A protective core for protecting the internal surface of a coil of strip material comprises, a cylindrical wall (5) formed from sheets (7, 9) of plastic material separated by webs (11) moulded integrally with the sheets to form tubular cavities extending transversely to the longitudinal axis of the core. The wall 5 is formed so that at least one of the surfaces of the wall (5) has surface irregularities (19, 21) which selectively reduce the thickness of the wall (5) compared to adjacent regions of the wall so that the wall (5) is sufficiently flexible to be folded to a collapsed form and held in that position without permanently damaging the wall (5) so that the wall (5) returns resiliently to its original cylindrical form when unfolded from the collapsed form.

6 Claims, 2 Drawing Sheets

PROTECTIVE CORE

The present invention relates to a core for protecting the internal surface of a coil of strip material.

It is known to fit a core formed from cardboard or steel into the bore of a coil of strip material to protect the internal surface of the coil from damage by the forks of fork-lift trucks or the like used to transport the coil from one location to another location.

However, the use of cardboard or steel cores is undesirable for environmental reasons. Furthermore, whilst this problem is alleviated to a certain extent because it may be possible to re-use cardboard or steel cores, this apparent environmental advantage is off-set to a large extent by the relatively large size of cardboard or steel cores which makes it generally inconvenient to transport the cardboard or steel cores back to a strip mill for storage and subsequent re-use.

It is an important requirement that cardboard or steel cores fit tightly into the bores of coils and therefore cannot be easily dislodged from the bores. It has been found that the only practical means by which this objective can be achieved is to position the cardboard or steel cores onto the coilers in the mill so that the strip material is coiled directly (and tightly) onto the cardboard or steel cores. The positioning of the cardboard or steel cores on the coilers can only be carried out manually and thus operators must periodically work in the coiling station of the strip mill. This is undesirable from the occupational health and safety perspective.

An object of the present invention is to provide a protective core for coils of strip material which alleviates the disadvantages of the known cardboard or steel coils described in the preceding paragraphs.

According to the present invention there is provided a core for a coil of strip material comprising, a cylindrical wall formed from sheets of plastic material separated by webs moulded integrally with the sheets to form tubular cavities extending transversely to the longitudinal axis of the core, at least one of the surfaces of the wall having surface irregularities which selectively reduce the thickness of the wall compared to adjacent regions of the wall so that the wall is sufficiently flexible to be folded to a collapsed form and held in that position without permanently damaging the wall so that the wall returns resiliently to its original cylindrical form when unfolded from the collapsed form.

It can readily be appreciated that, in use, by selecting the outer diameter of the core to match the diameter of the bore of a coil of strip material, the core can be fitted tightly into the bore by folding the wall into the collapsed form, positioning the core whilst held in the collapsed form into the bore of the coil, and unfolding the wall so that the wall resiliently returns to the original cylindrical form.

It is preferred that the webs are parallel so that the tubular cavities are parallel.

It is preferred that the surface irregularities comprise indentations which extend in lines that are transverse to the longitudinal axis of the core and to the tubular cavities.

It is particularly preferred that there is a first set of parallel lines of indentations and a second set of parallel lines of indentations which intersect to form a generally rectangular array.

In an alternative arrangement, it is preferred that the surface irregularities comprise indentations which extend in a generally tortuous path so that a substantial part of the lines are transverse to the longitudinal axis of the core and to the tubular cavities.

According to the present invention there is also provided, in combination, a coil of strip material having a central bore, and the core described in the preceding paragraphs tightly fitted in the bore to protect the internal wall of the coil.

The present invention is described further with reference to the accompanying drawings in which.

Figure 1:
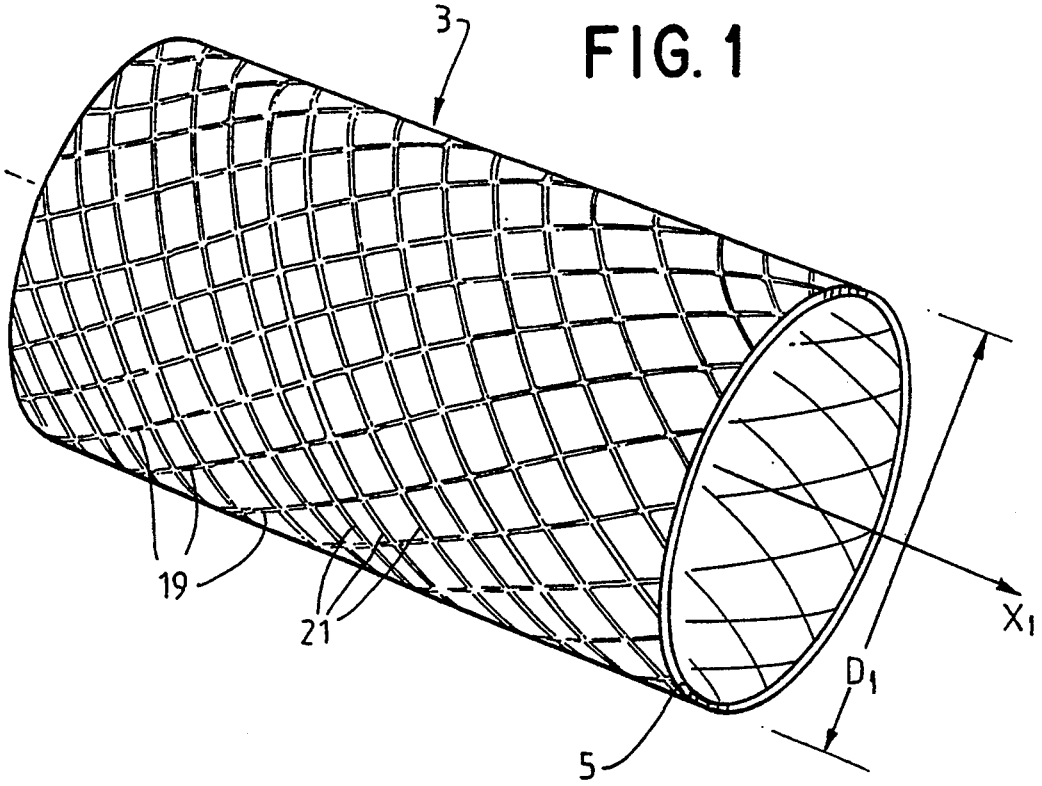
FIG. 1 is a perspective view of a preferred embodiment of a core formed in accordance with the present invention, in an unfolded position.

The preferred embodiment of the core 3 for a coil of strip material shown in FIG. 1 comprises a cylindrical wall 5 having an outer diameter $D_1$ which closely matches the diameter of the bore of the coil so that the core can be fitted tightly into the bore. The wall 5 is formed from a plastic board which has surface irregularities so that the wall 5 is sufficiently flexible to be folded into a collapsed position shown in FIG. 2 and held in that position without permanently damaging the wall 5 so that the wall 5 returns resiliently to its original cylindrical form when unfolded.

Figure 2:
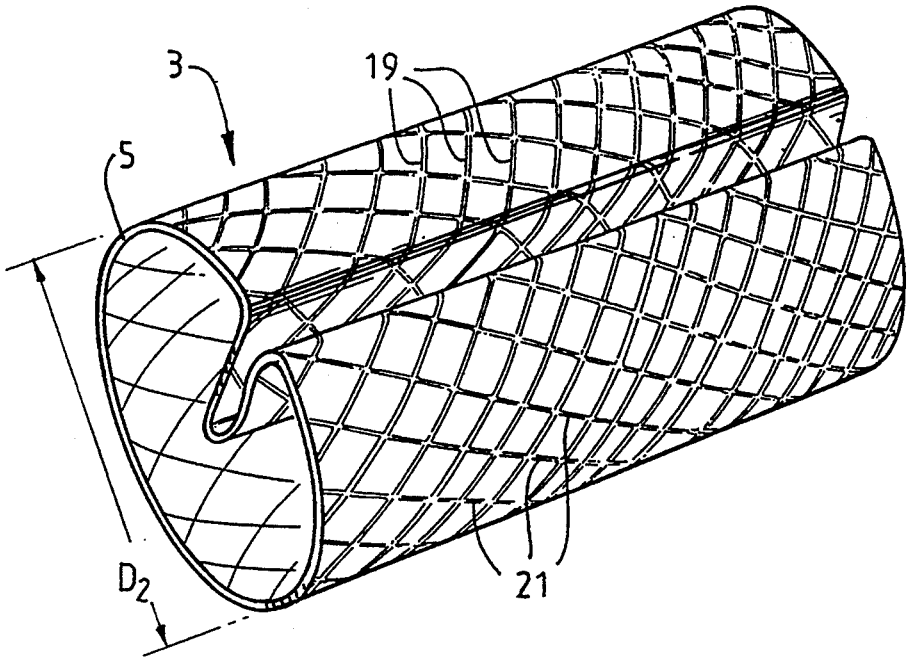
FIG. 2 is a perspective view of the core shown in FIG. 1, in a collapsed position.

It is noted that in the collapsed position shown in FIG. 2 the core 3 has an effective outer diameter $D_2$ which is less than the outer diameter $D_1$ of the core in the original cylindrical form shown in FIG. 1.

As a consequence, in use, by selecting the outer diameter of the core 3 to closely match that of the bore of a coil of strip material, the core 3 can be fitted tightly into the bore by folding the wall 5 into the collapsed form, positioning the core 3 whilst held in the collapsed form into the bore of the coil, and unfolding the wall 5 so that the wall 5 resiliently returns to the original cylindrical form.

Figure 3:
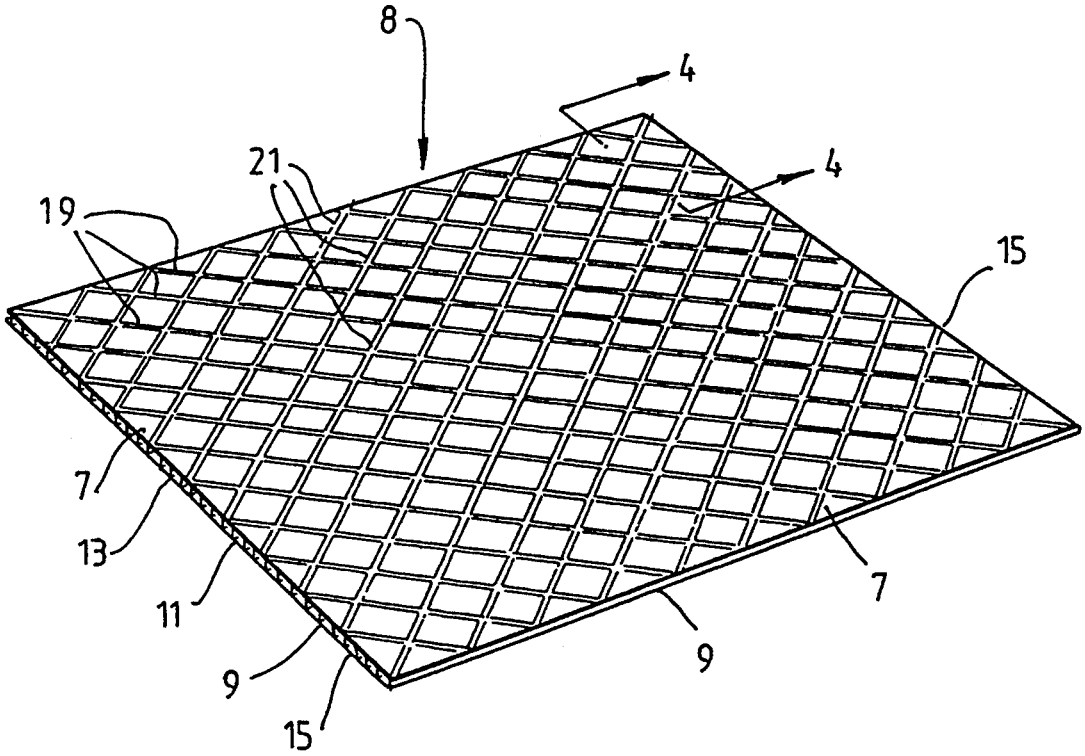
FIG. 3 is a perspective view of a sheet of plastic board for use in forming the core shown in FIGS. 1 and 2.
Figure 4:
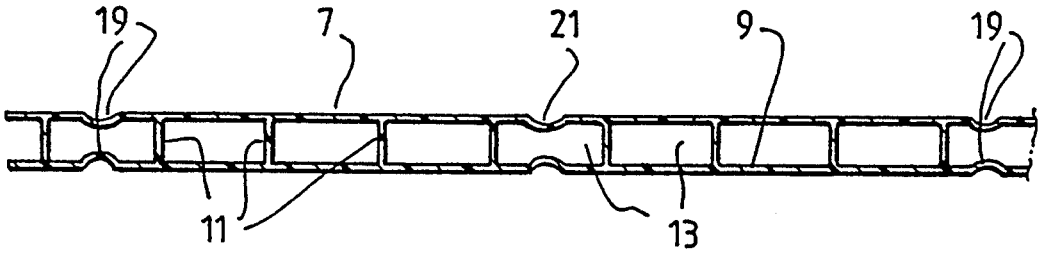
FIG. 4 is a section along the line 4—4 in FIG. 3.

With reference to FIGS. 3 and 4, in the preferred embodiment of the present invention, the cylindrical wall 5 is formed by folding a rectangular sheet of plastic board, generally identified by the numeral 8, into a cylinder and welding the opposed ends 15 of the rectangular sheet to form a seam.

The plastic board 8 comprises sheets 7, 9 of plastic material separated by parallel webs 11 integrally moulded with the sheets 7, 9 to form parallel tubular cavities 13 extending between the opposed ends 15 of the plastic board 8.

The plastic board as shown in FIG. 3 further comprises surface irregularities in the form of a rectangular array of indentations in both surfaces of the plastic board which are formed by pressing two intersecting sets of lines of indentations 19, 21 in the surfaces of the plastic board to selectively reduce the thickness of the plastic board. The lines of indentations 19, 21 are selectively arranged to extend transversely to the webs 11 and the tubular cavities 13 and a perpendicular axis, which is the longitudinal axis $X_1$ in the finished product shown in FIG. 1. It can readily be appreciated that such surface irregularities in effect form lines of weakness which increase the flexibility of the otherwise relatively stiff plastic board and allow the wall 5 in the finished product shown in FIG. 2 to be folded inwardly without permanently damaging the construction of the plastic board 8 so that the plastic board can return resiliently to the cylindrical configuration.

The preferred embodiment of the core of the present invention described above has a number of significant advantages over the conventional cardboard or steel core. For example, the core can be transported and stored in a collapsed position thus greatly reducing the inconvenience associated with transporting and storing conventional cardboard or steel cores. Furthermore, the core can be installed and removed off-line thereby negating the need for operators to periodically access the coiler and uncoiler areas of strip mills as is currently required with conventional cardboard or steel cores.

Many modifications to the preferred embodiment of the core of the present invention may be made without departing from the spirit and scope of the present invention.

For example, whilst the preferred embodiment describes that the surface irregularities in the plastic board are formed by pressing a rectangular array of indentations into the surface of the plastic board, it can readily be appreciated that the present invention is not so limited and extends to any suitable means for forming the surface irregularities in a plastic board.

Furthermore, whilst the preferred embodiment describes that the lines of indentations, which form the surface irregularities, extend transversely to the tubular cavities in the plastic board and to a perpendicular axis, which forms the longitudinal axis in the product, it can readily be appreciated that the present invention is not so limited and extends to any suitable arrangement of surface irregularities.

I claim:

1. A core for a coil of strip material, said core comprising:

a cylindrical wall formed from sheets of plastic material separated by webs moulded integrally with the sheets to form tubular cavities extending transversely to the longitudinal axis of the core, said sheets forming inner and outer surfaces of the wall, with at least one of the inner and outer surfaces of the wall having surface irregularities which selectively reduce a thickness of the wall compared to adjacent regions of the wall so that the wall is sufficiently flexible to be folded to a collapsed form and held in the collapsed form without permanently damaging the wall so that the wall returns resiliently to its original cylindrical form when unfolded from the collapsed form.

2. The core defined in claim 1, wherein the outer diameter of the core is selected to match the diameter of the bore of the coil of strip material so that, in use, the core can be fitted tightly into the bore by folding the wall into the collapsed form, positioning the core whilst held in the collapsed form into the bore of the coil, and unfolding the wall so that the wall resiliently returns to the original cylindrical form.

3. The core defined in claim 1, wherein the webs are parallel so that the tubular cavities are parallel.

4. The core defined in claim 1, wherein the surface irregularities comprise indentations which extend in lines that are transverse to the longitudinal axis of the core and to the tubular cavities.

5. The core defined in claim 4, wherein there is a first set of parallel lines of indentations and a second set of parallel lines of indentations which intersect to form a generally rectangular array.

6. In combination, a coil of strip material having a central bore, and the core defined in any one of the preceding claims tightly fitted in the bore to protect the internal wall of the coil.

* * * * *